US009016010B2

(12) United States Patent
Sønderkær et al.

(10) Patent No.: US 9,016,010 B2
(45) Date of Patent: Apr. 28, 2015

(54) PANE MODULE FOR USE IN A WINDOW

(71) Applicant: VKR Holding A/S, Høsholm (DK)

(72) Inventors: Peter Sønderkær, Horsens (DK); Kristian Ørnsvig Nielsen, Hornsyld (DK); Lars Kristensen, Ostbirk (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 14/251,871

(22) Filed: Apr. 14, 2014

(65) Prior Publication Data

US 2014/0305053 A1 Oct. 16, 2014

Related U.S. Application Data

(62) Division of application No. 12/733,001, filed as application No. PCT/DK2008/050190 on Jul. 31, 2008, now Pat. No. 8,943,769.

(30) Foreign Application Priority Data

Aug. 3, 2007 (DK) ..... 2007 01117

(51) Int. Cl.
*E04B 7/14* (2006.01)
*E06B 3/66* (2006.01)
(Continued)

(52) U.S. Cl.
CPC ..... *E06B 3/6621* (2013.01); *E06B 3/663* (2013.01); *E04D 12/002* (2013.01);
(Continued)

(58) Field of Classification Search
CPC ..... B60J 10/02; B60J 1/02; B60J 10/0045; B60J 10/0017; B60J 1/001; B60J 10/0054; E04D 2003/0893; E04D 2003/0806; E04D 13/04; E04D 13/0445; E06B 1/702; E06B 2001/628; E06B 7/14; E06B 3/4609
USPC ..... 52/200, 204.5, 208, 204.55, 204.593, 52/204.6, 209
See application file for complete search history.

(56) References Cited

U.S. PATENT DOCUMENTS 1,301,737 A 4/1919 Pierce
1,713,555 A 5/1929 Reuter
(Continued)

FOREIGN PATENT DOCUMENTS

BE 854963 9/1977
CH 369277 5/1963
(Continued)

OTHER PUBLICATIONS

English language Abstract of Japanese patent document No. 2002353714, 1 page.
(Continued)

*Primary Examiner* — Brian Glessner
*Assistant Examiner* — Gisele Ford
(74) *Attorney, Agent, or Firm* — Merek, Blackmon & Voorhees, LLC

(57) ABSTRACT

The pane module is adapted to be installed in a window frame and comprises a pane element and a border element (91). The pane element includes at least two sheet elements (92, 94), such as sheets of glass, separated by one or more spacer members (93). The border element (91) is made by molding and surrounds the pane element, at least partially encasing the edge of at least one sheet element. In order to provide the pane module with a number of functionalities traditionally performed by the frame, the pane module comprises at least one functional face.

19 Claims, 6 Drawing Sheets

Figure 1:
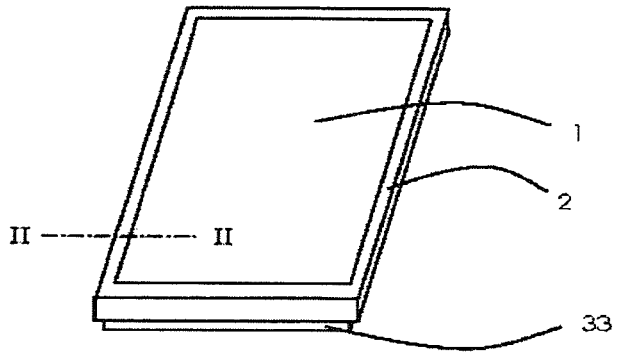

(51) Int. Cl.

| | |
|---|---|
| ***E06B 3/663*** | (2006.01) |
| ***E04D 12/00*** | (2006.01) |
| ***E06B 3/54*** | (2006.01) |
| ***E06B 7/28*** | (2006.01) |

(52) U.S. Cl.

CPC ..... *E06B 3/5427* (2013.01); *E06B 3/66328* (2013.01); *E06B 7/28* (2013.01); *E06B 3/5454* (2013.01); *E06B 3/66309* (2013.01)

(56) References Cited

U.S. PATENT DOCUMENTS

| | | | | |
|---|---|---|---|---|
| 1,796,242 | A | 3/1931 | Cooper | |
| 1,909,875 | A * | 5/1933 | Lundgaard | 62/163 |
| 1,947,736 | A | 2/1934 | Potter | |
| 1,961,352 | A | 6/1936 | Hall | |
| 2,050,733 | A | 8/1936 | Ross | |
| 2,205,522 | A | 6/1940 | Fix | |
| 2,626,434 | A | 1/1953 | Ike | |
| 2,781,111 | A | 2/1957 | Kunkel | |
| 2,866,527 | A | 12/1958 | Schilling | |
| 3,299,591 | A | 1/1967 | Woelk | |
| 3,308,582 | A | 3/1967 | Bakke | |
| 3,665,661 | A | 5/1972 | Beckerer | |
| 4,024,690 | A * | 5/1977 | Collins et al. | 52/204.591 |
| 4,205,104 | A | 5/1980 | Chenel | |
| 4,314,424 | A | 2/1982 | Gordon et al. | |
| 4,495,726 | A | 1/1985 | Lindstrom | |
| 4,563,846 | A | 1/1986 | Webb | |
| 4,570,399 | A | 2/1986 | Wentink | |
| 4,676,026 | A | 6/1987 | Schreiner | |
| 4,712,287 | A | 12/1987 | Johnston | |
| 4,822,649 | A * | 4/1989 | Canaud et al. | 428/34 |
| 4,830,038 | A | 5/1989 | Anderson et al. | |
| 4,909,875 | A | 3/1990 | Canuad et al. | |
| 4,951,927 | A | 8/1990 | Johnston et al. | |
| 5,038,537 | A | 8/1991 | Frambach | |
| 5,061,531 | A * | 10/1991 | Catalano | 428/34 |
| 5,081,793 | A | 1/1992 | Mauro | |
| 5,111,618 | A | 5/1992 | Kaspar et al. | |
| 5,300,346 | A * | 4/1994 | Tamura et al. | 428/156 |
| 5,355,625 | A | 10/1994 | Matsuoka | |
| 5,410,846 | A | 5/1995 | Frambach | |
| 5,687,518 | A | 11/1997 | Endo et al. | |
| 5,784,839 | A | 7/1998 | LaVanway | |
| 6,138,341 | A | 10/2000 | Barroero et al. | |
| 6,216,417 | B1 * | 4/2001 | Morin et al. | 52/786.1 |
| 6,245,396 | B1 | 6/2001 | Nogami | |
| 6,572,355 | B1 | 6/2003 | Bauman et al. | |
| 6,643,984 | B2 | 11/2003 | Kato et al. | |
| 6,837,022 | B2 | 1/2005 | Ito | |
| 6,979,041 | B2 * | 12/2005 | May et al. | 296/93 |
| 7,546,711 | B2 | 6/2009 | Salzer | |
| 8,484,916 | B2 | 7/2013 | Farag | |
| 8,720,135 | B2 | 5/2014 | Sonderkaer et al. | |
| 2003/0072899 | A1 | 4/2003 | Compton et al. | |
| 2003/0200718 | A1 | 10/2003 | Ito | |
| 2005/0217798 | A1 | 10/2005 | Sugiyama et al. | |
| 2006/0096539 | A1 | 5/2006 | Kawasaki et al. | |
| 2009/0277111 | A1 | 11/2009 | Albrecht et al. | |
| 2010/0199591 | A1 | 8/2010 | Sonderkaer et al. | |
| 2010/0205879 | A1 | 8/2010 | Sonderkaer et al. | |
| 2010/0205881 | A1 | 8/2010 | Sonderkaer et al. | |
| 2011/0047881 | A1 | 3/2011 | Bjorn et al. | |
| 2012/0137607 | A1 | 6/2012 | Kristensen et al. | |

FOREIGN PATENT DOCUMENTS

| | | |
|---|---|---|
| CN | 2864315 | 1/2007 |
| CN | 101258297 | 9/2008 |
| DE | 1945291 | 5/1971 |
| DE | 2342607 | 4/1974 |
| DE | 3708912 | 9/1987 |
| DE | 9110698 | 11/1991 |
| DE | 4325119 | 2/1995 |
| DE | 4337702 | 5/1995 |
| DE | 4427402 | 2/1996 |
| DE | 29607923 | 8/1996 |
| DE | 19640551 | 4/1998 |
| DE | 19642175 | 4/1998 |
| DE | 10059849 | 5/2001 |
| DE | 20304015 | 5/2003 |
| DE | 20218215 | 4/2004 |
| DE | 202004009269 | 8/2004 |
| DE | 102004041533 | 3/2006 |
| DE | 102004049120 | 4/2006 |
| DE | 102006010646 | 10/2006 |
| EP | 0384462 | 8/1990 |
| EP | 0733146 B | 6/1997 |
| EP | 1136644 | 9/2001 |
| EP | 1038083 | 3/2002 |
| EP | 1681399 | 7/2006 |
| EP | 1691000 A | 8/2007 |
| EP | 1873323 | 1/2008 |
| EP | 1655443 | 11/2012 |
| FR | 1381137 | 12/1964 |
| FR | 2340439 | 9/1977 |
| FR | 2514057 | 4/1983 |
| FR | 2666636 | 3/1992 |
| FR | 2717854 | 9/1995 |
| FR | 2843161 | 2/2004 |
| FR | 2845415 | 4/2004 |
| GB | 1132070 | 10/1968 |
| GB | 1417342 | 12/1975 |
| GB | 2005330 A | 4/1979 |
| GB | 2077834 | 12/1981 |
| GB | 2245861 | 1/1992 |
| JP | 9232846 | 9/1997 |
| JP | 10276023 | 10/1998 |
| JP | 2002353714 | 12/2002 |
| JP | 2003321258 | 11/2003 |
| NL | 7503816 | 10/1976 |
| WO | 96/24963 | 8/1996 |
| WO | 9928581 | 6/1999 |
| WO | 0125581 | 4/2001 |
| WO | 02/057564 | 7/2002 |
| WO | 2006/133298 | 12/2006 |
| WO | 2007/028392 | 3/2007 |
| WO | 2009/018831 | 2/2009 |

OTHER PUBLICATIONS

English language Abstract of Japanese patent document No. 10276023, 1 page.

English language Abstract of Japanese patent document No. 2003321258, 1 page.

* cited by examiner

PANE MODULE FOR USE IN A WINDOW

The present application is a division of U.S. patent application Ser. No. 12/733,001 filed on Apr. 21, 2010, which is a 371 application of International Application No. PCT/DK2008/050190 filed on Jul. 31, 2008 which claims priority from foreign application No. PA 2007 01117 filed in Denmark on Aug. 3, 2007. Ser. No. 12/733,001 is hereby incorporated herein by reference in its entirety.

The invention relates to a pane module for a window for use in residential, office or industrial buildings and to a window with such a pane module.

When glazing vertical windows as well as roof windows the pane is usually secured to a glass-carrying frame, i.e. traditionally the sash, by means of glazing profiles fastened to the frame by means of screws. The pane is kept in place by means of glass spacers and glazing clips. Though it has proven very efficient this method suffers from a number of disadvantages, among others the large number of different parts needed for the glazing and the fact that the discontinuous support may cause potentially destructive strains on the pane, particularly when using a conventional glass sheet pane. This influences the lifespan of the pane with respect to breakage and failure in the sealing, the latter resulting in the formation of condensation in the space between the two sheets of glass constituting the pane.

More recently, attempts have also been made to attach the pane to the frame by means of gluing. This has provided a continuous support for the pane, enabling it to carry a larger share of the loads inflicted by wind and other weather-related factors. This, in turn, allows the use of more slender frame profiles with reduced weight and the design of the frame profiles may be dedicated to the achievement of improved insulation properties. Last but not least, the slimmer frame structures allow an increase of the pane area, increasing the inlet of light and thereby the utilization of the free heating of the sun.

In recent years the technology of gluing has developed into a realistic alternative to a conventional glazing of a pane module, as it is now possible to make a glued connection, which has a good resistance to dynamical loads, heat, UV and even moisture. Gluing has for example been used in the so-called "instant glazing" technique, where adhesive replace sealing and rubber gaskets, and pane modules have been glued to the sash or glazing profile to obtain a structural connection between pane and sash or frame.

Gluing technology has, however, not penetrated the large volume market for windows and the application in fenestration and glazing still has several unsolved problems. For instance, a satisfactory solution to the problem of securing the pane in the event of adhesion failure has not been provided, and design criterias relating to strength and mechanical properties of the glue are also lacking. Moreover, the quality of the glued connection is sensitive to the environment at the location where the gluing is performed, to the preparation of the adhesion surfaces etc. and the employees performing the gluing must therefore be specially trained. This entails the necessity of large investments in climate control, quality control systems and staff training. Standards for pane and window design criteria's have not yet been provided.

It is therefore the object of the invention to provide a window, in which a secure and durable glazing may be provided with the use of fewer parts than what is needed for conventional glazing.

This is achieved with a pane module adapted to be installed in a window frame and comprising a pane element and a border element, wherein the pane element includes at least two sheet elements, such as sheets of glass, separated by one or more spacer members, wherein the border element is made by moulding, wherein the border element surrounds the pane element, at least partially encasing the edge of at least one sheet element, and wherein the border element has at least one functional face.

The border element gives a continuous support along the entire edge of the pane and may be attached directly to a window frame, thus making the use of glazing clips etc. redundant. The term "frame" covers both stationary and moveable frames including traditional sashes. Furthermore, the term includes such elements, which includes other elements as well, and the pane module may be used with any type of window regardless of the number of frames forming part of the window.

The fact that the border element encases the edge of the pane or at least a sheet element thereof means that the pane is securely retained without the use of glue or the like, leading to a secure and resistant attachment. The term "encase" should not be understood as if the border element encloses or embraces the entire edge of the pane both on the interior and the exterior side; the mere contact between surfaces of the border element and pane may give a sufficient attachment.

The terms "interior" and "exterior" refers to the orientation of the window when mounted in a building, the interior sheet facing the indoors of the building and the exterior sheet facing the outdoors. This terminology will be applied throughout the description. In FIGS. 2-9 the exterior side of the pane is facing upwards and the interior side is facing downwards.

Thanks to the continuous connection between the pane and the border element, which is in turn connected to the window frame, the pane module may function as a structural element contributing to bearing the loads affecting the window. This entails a different load distribution on the borders of the pane in comparison with a conventional pane, which again necessitates the use of glass, preferably tempered or annealed, that is thicker than that used when mounting the pane in a conventional manner, where there is no structural connection between the pane and the frame.

When designed appropriately, the border element may be detachable from the window frame allowing the pane to be easily replaced, which is not possible when the pane is glued to the frame. This will not only allow an easy replacement of broken panes; if detachment and attachment are made suitably easy, the pane module may be changed depending for example on changing insulating requirements, e.g. changing between a summer pane and a winter pane.

When using conventional thermo panes and the like, the border element may encase the edge of the pane entirely. Other types of panes, however, have projecting edges that may be used for the attachment of the border element. One example is step unit panes, where the edge of one of the glass sheet elements projects over the edge of the other and over the spacer members. The border element may then be attached to the edge of the projecting sheet element.

Regardless of the pane type, the sheet elements may be parallel to each other, as is most commonly the case, or one may be inclined in relation to the other so that the distance between them vary. This latter kind of pane has particularly good sound insulating properties and the principle may also be applied to three-sheet panes to thereby achieve an even better sound-proofing. Also, a combination of several pane elements arranged side-by-side or one above another in a single border element may be used, the former being advantageous when using vacuum panes that are difficult to make in larger sizes and the latter allowing the formation of multi-sheet pane elements.

Pane elements are usually rectangular, but other shapes such as square, circular, semi-circular or trapezoidal may also be used. The border element will usually be of the same shape as the pane, but variations are possible. For example a trapezoidal pane may be encased in a rectangular border element, the width of the border element varying to compensate for the difference in shape, or a rectangular pane may be encased in a trapezoidal border element to thereby make it appear trapezoidal.

Depending among others on the type of pane element and the functionalities to be possessed, the border element may encase all edges of at least one sheet element or only some of them. Encasing all edges gives a particularly good hold of the pane element, but to allow the subsequent addition of associated elements such as roller shutters it may be advantageous to leave one or more edges of at least one of the sheet element free. Particularly when using step unit panes the encasement may also be limited to only one of the two sheet elements, but in other cases it may be advantageous that edges of each of the two sheet elements are encased by the border element. An obvious example is the encasement of thermo panes, where the border edges of the two sheet elements are in line. The insulating properties of a step unit pane module may also be improved by encasing both sheet elements and the encasing border element may function as a secondary sealing of the pane element. For some uses it may even be advantageous to combine these two approaches so that the interior sheet element is encased at the top and bottom, whereas the exterior sheet element are encased at the sides or vice versa.

Apart from the attachment of the pane, the functional face or faces of the border element may serve as a seat for a number of functions necessary for the functionality of the window, amongst others covering member carriers, water guidance means, electrical components, sealings and components contributing to the stiffness and strength of the construction. These functions have hitherto been associated with the frame or frames of the window and the provision of a border element having functional faces thus allows a simpler construction of the frame elements. This again entails that the frame elements may be less specialized and may therefore be used for a larger number of different windows, which in turn simplifies manufacturing processes. Typically, functions relating to the operation of the window, e.g. the positioning of the hinges, will be maintained in the frame, whereas functions relating to weatherproofing and screening will be with the border element. In this way one frame may be used for any centre-hung window of a particular size, while features such as the colour of the exterior surface, whether the window should have a roller shutter etc. are determined by the choice of border element. Ultimately, this may result in a pick-and-click system, where particular demand as regards colour, insulation properties, sound dampening etc., may be met. By choosing an appropriate way of attaching the pane module to the frame, it will even be possible to change the characteristics of an already mounted window or add features thereto by simply replacing the pane module.

One example of a functional face is that the border element has a nose projecting over the edge of the pane element above the surface facing the exterior in the mounted state, the nose covering the joint between the pane element and the border element. In this way the exterior face of the border element serves the function of protecting the joint and the nose will furthermore serve as a safety device retain the pane in the unlikely event that the connection between the border element and the pane should fail. If serving only retention purposes the nose need not be present over the entire extend of the border member, but may only constitute local projections. The exterior face of the border element may, however, also be level with the exterior surface of pane, to thereby serve the function of draining off rainwater, or be level with the interior surface of pane, serving only as a face of attachment and allowing the pane to project over the border element and frame. In still another embodiment, the exterior face of the border element is provided with a feather projecting substantially perpendicularly to the plane of the pane. Such a feather may serve as a guide for water to be drained off, preventing it from penetrating into the joint between the window and the facade or roof, in which it is mounted, or between frames.

The term "functional face" is not strictly limited to properties of the moulding material or moulded part of the border element. On the contrary, a fitting embedded in the material and projecting through the face may impart the functionality. Such a fitting may for example serve as a nose or feather as mentioned above or be used for connecting the border element to a cladding element, to a screening element or to a window frame. The fittings may be rails extending over the entire length of one or more members of the border element or may be of a less elongate configuration and attached locally on the border element.

Even the cross section of the border element may be said to serve as a functional face, when functional elements are embedded therein. This may for example be utilized in centre-hung roof windows, where wind loads are sometimes high and where the pane may therefore be subject to great compressive forces caused by wind suction on the lowermost half of the pane. Using tempered or annealed glass will make the pane less sensitive to such influences, but will also increase costs. It can therefore be advantageous to provide a prestressing of the border element by embedding a tensioned cable in the material of the border element at a level below the level of the pane. The compressive force thus applied to the material of the border element will counter the force of the wind and will thus reduce the stresses affecting the pane.

The border members constituting the border element and corresponding in number to the number of edges of the pane may be of different designs depending on the different demands. If, for example, the border element is provided with an outwards projecting feather, the feather on the lower member of the border element may be provided with drain holes or interruptions or a part of the border element may be left without the feather.

The border element is preferably made from a thermoplastic material, preferably polyurethane or polyolefin. Other conceivable materials include thermoplastic materials such as PVC, PE or PP, a thermoplastic elastomeric (TPE) and thermoset elastomer materials such as ethylene propylene diene monomer (EDPM). Reaction injection moulding (RIM) or low pressure moulding may be used for the manufacture.

Figure 2A:
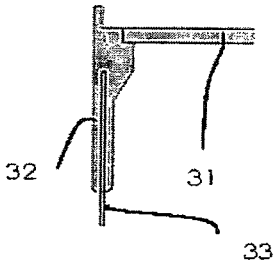
Figure 2B:
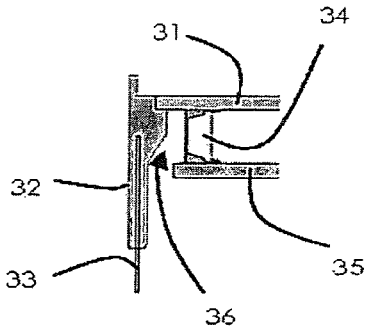
Figure 3:
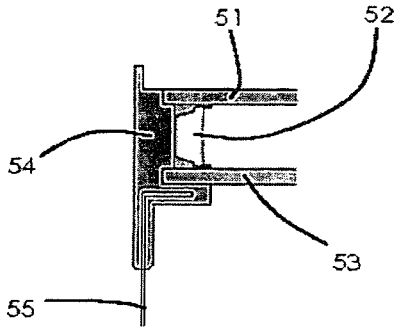
Figure 4A:
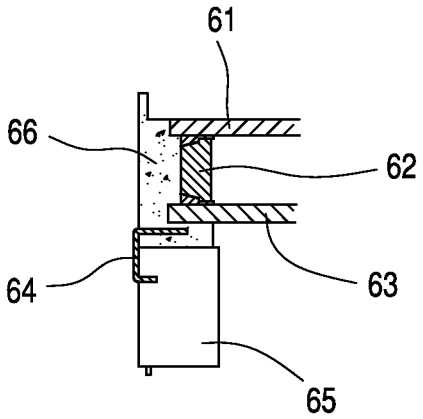
Figure 4B:
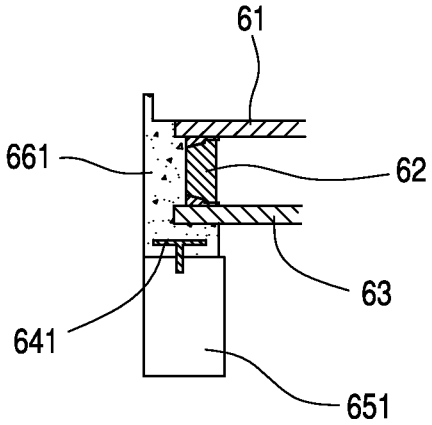
Figure 5:
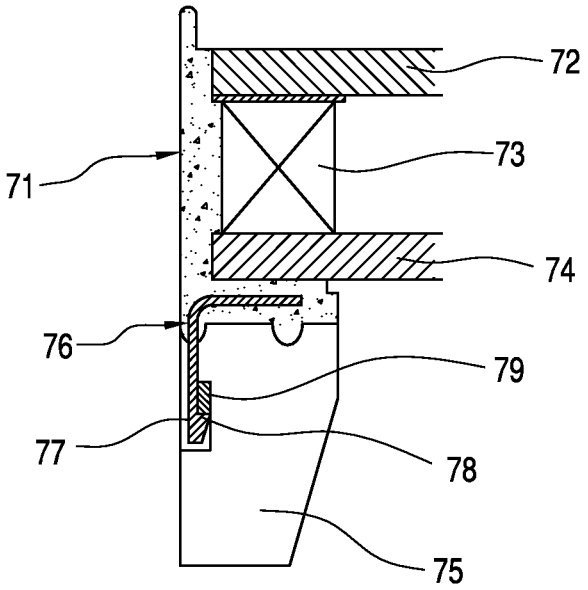
Figure 6:
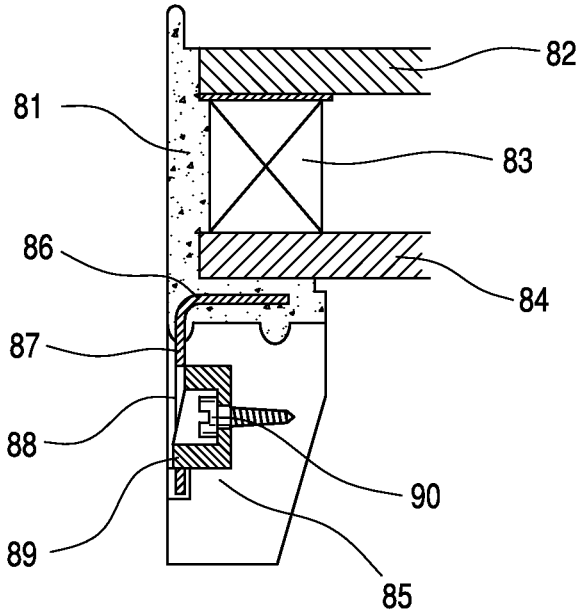
Figure 7:
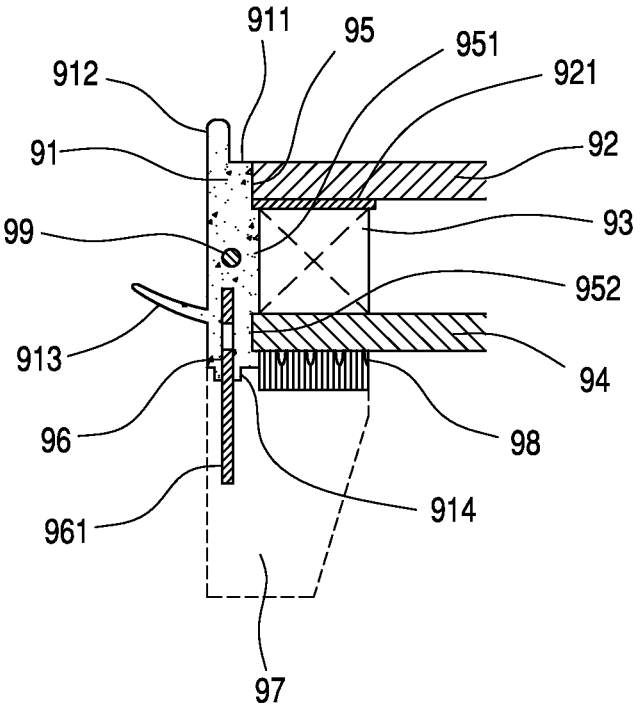
Figure 8:
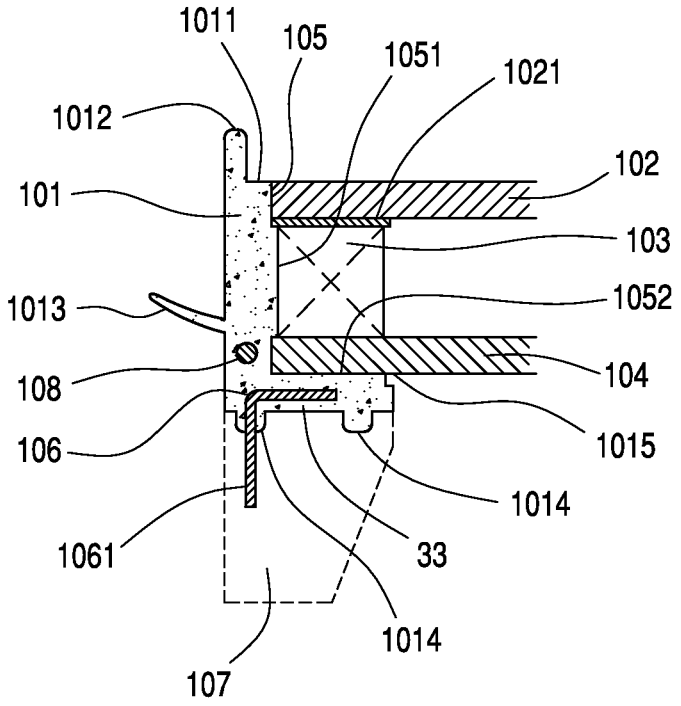
Figure 9:
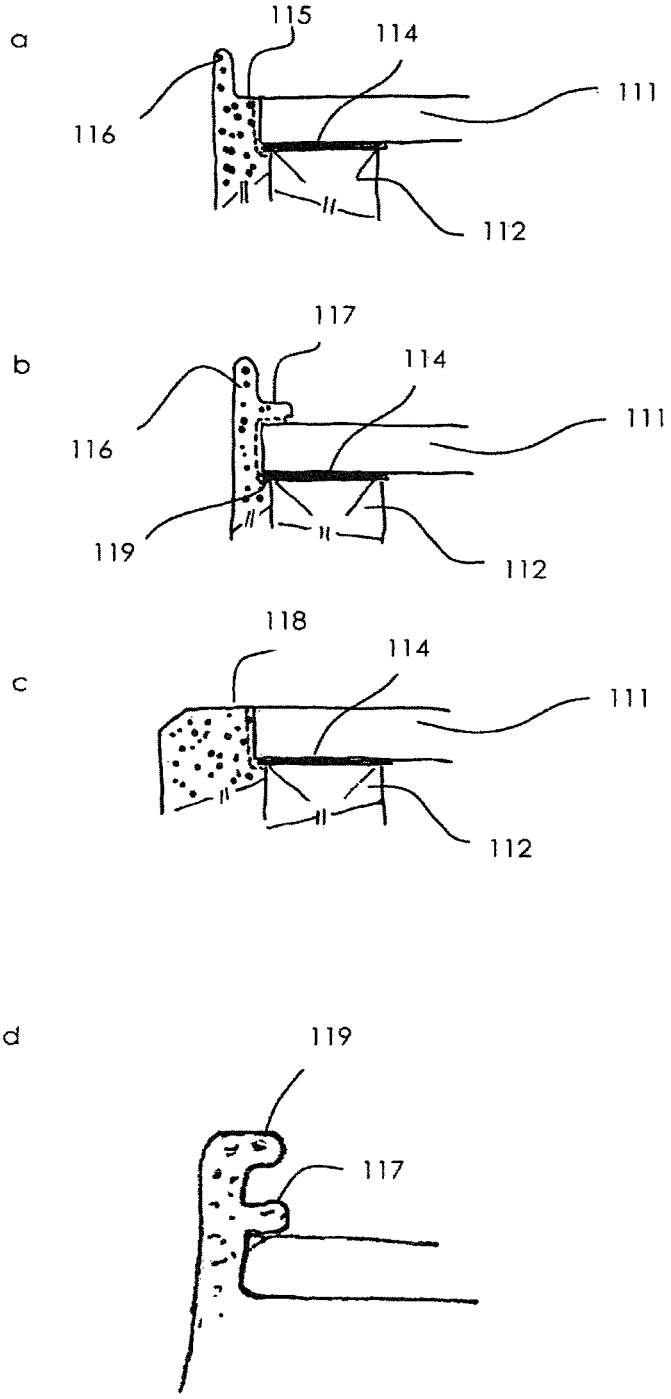
Figure 10:
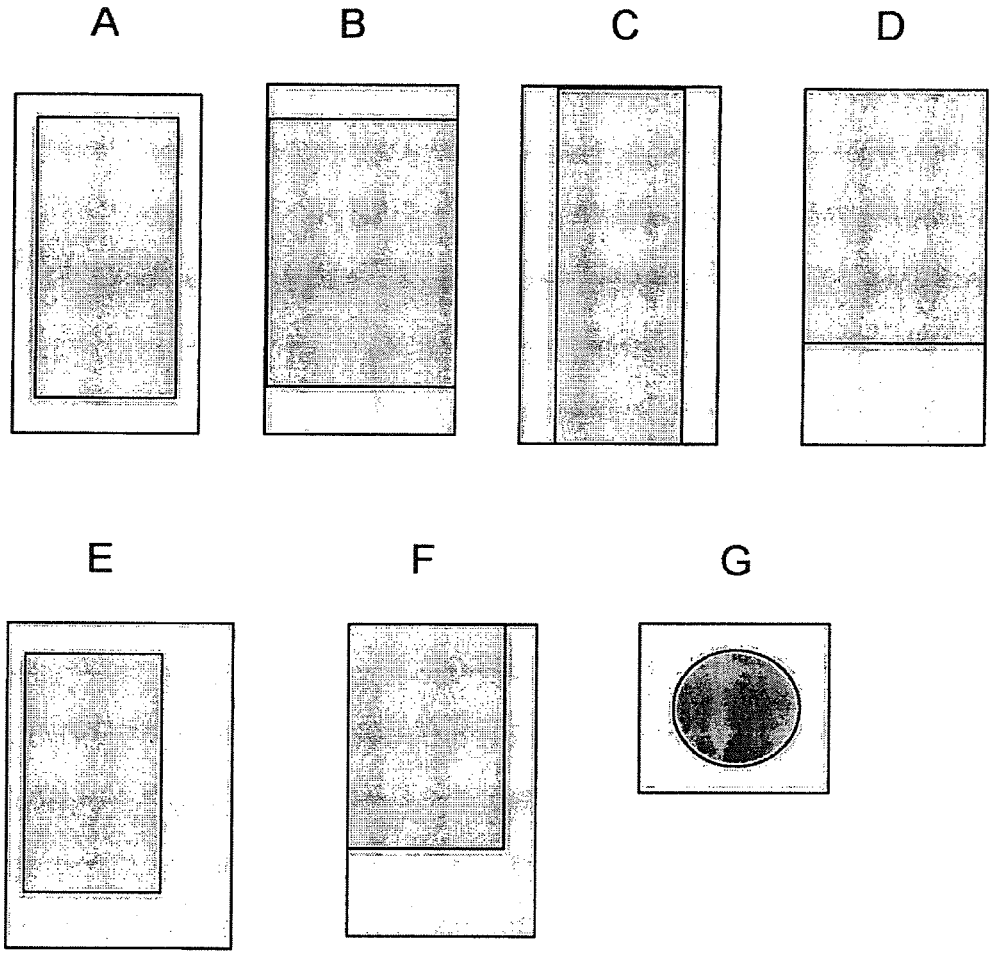

In the following, the invention will be described in further detail with reference to the drawing in which:

FIG. 1 is a perspective view of a bordered pane module according to the invention, FIGS. 2*a* and 2*b* are cross sectional views taken along the line II-II in FIG. 1 and illustrating the manufacture and encasement of a step unit pane, FIG. 3 is a cross sectional view corresponding to the ones in FIGS. 2*a* and 2*b* but with a thermo pane, where the entire edge is encased in the border element, the border element being attached also to the sealing, FIGS. 4*a* and 4*b* are cross sectional views corresponding to the one in FIG. 3 and showing the integration of the frame in the border element, FIG. 5 is a cross sectional view corresponding to the one in FIG. 3 and showing the attachment of the border element to the frame by means of a click-on system, FIG. 6 is a cross sectional view corresponding to the one in FIG. 3 and showing the attachment of the border element to the frame by means of a fitting attached to the frame with screws, FIGS. 7 and 8 are a cross sectional views corresponding to the one in FIG. 3 and showing border elements with straight and angled fittings, respectively, FIG. 9 shows three cross sectional views corresponding to the one in FIG. 3 but partially cut away and showing different modes of attachment of the border element to the pane, and FIG. 10 shows examples of different configurations of step unit panes.

One embodiment of a bordered pane module according to the invention is shown in FIG. 1. The pane module may be used for any type of window installed either vertically or inclined in the facade or the roof of any residential, office or industrial building. It comprises a pane element 1 (also referred to as pane in the following) and a border element 2 made preferably from polyurethane, said border element being produced by moulding around the pane element. One of the main functions of the border element is to serve as a structural joint between the pane element and a frame element (not shown) of a window.

In the embodiment shown, the border element 2 surrounds the entire periphery of the pane element, but it is to be understood that it may also be U-shaped surrounding the pane on three of its four sides or that separate elements may be used on each side leaving the corners of the pane free. Similarly it is to be understood that pane modules with other geometrical configurations are also conceivable, i.e. a pane module having a semicircular or triangular shape is also within the scope of the invention.

The border element 2 may be produced by using any suitable moulding technique. In the embodiment described, use is made of injection moulding, e.g. reaction injection moulding (RIM). When using the RIM process fittings, current-carrying components, plastic or metal components contributing to strength and stiffness, screws etc. may be moulded into the border element. Furthermore, the RIM process allows the integration of details such as sealings in the border element.

RIM is a process that is well known per se. During moulding, a two-component curing polyurethane is mixed in the mould containing the pane to be encased. In the mould a pressure of approximately 6 to 10 bar is obtained during the curing process. The cured module is ready to be handled within approximately 45 to 60 seconds. During the RIM process itself the temperature of the material and the mould lies between 80 and 110° C. depending on the configuration of the mould and whether the polyurethane used is of the aromatic or the aliphatic kind. Depending on the kind of polyurethane used, different Shore A hardnesses may be obtained. In the example polyurethane having a cured hardness of 60-90 Shore A may be used.

Wherever polyurethane (PUR) is mentioned in the description it is to be understood that other materials may also be used, possibly with slight adaptations, which will be obvious to the person skilled in the art.

The pane element will usually be composed of monolithic glass elements. In this context the term "monolithic glass" covers annealed glass, tempered glass, laminated glass, wired glass, figured or patterned glass as well as other types of glass that are used in conventional panes. Even though the sheet elements of the pane are referred to as being made from glass, it is to be understood that Plexiglas (also known as Perspex) or any other sheet element, transparent or not, which is suited for the particular use of the window, may also be employed, including luminescent materials. The glass may have coatings on one or both sides. The cavity between the sheet elements may be filled with dry air, gas such as Ar, Kr or Xe, or with gas mixtures suitable for improving the insulating properties of the pane by reducing its U value. A vacuum pane may also be used as may a pane with a layer of aerogel filling the space between the sheet elements. If using a pane type that can best be made in relatively small units, such as vacuum panes, a series of pane elements may be arranged side-by-side for the formation of a larger element of the desired size. This method may also be used for providing different areas of the pane with different properties such as colour, opacity, insulation etc.

The spacer members, which are usually in the form of elongate distance profiles extending along the entire side of the pane, may be made from metal or plastic. A series of local spacer members arranged separately along the side of the pane or even across the pane may, however, also be used. A desiccant may be deposited in hollow spacer members, embedded in a matrix or in a getter element in each of the cavities delimited by the glass sheets and the spacer members. Moreover, the spacer members, particularly when in the form of distance profiles, may be provided with additional functionalities, such as sound dampening features, or additional members providing such functionalities may be provided in between the sheet elements of the pane.

The sheet elements of the pane are normally plane and parallel to each other. They may, however, also be curved for use with a skylight of the curb type and the distance between them may vary, which may improve the sound insulating properties of the pane.

The pane elements may be conventional type panes, where all glass sheets have identical size and shape, or may be step units. Step units are panes, where the different glass sheets have different length and/or width so that one sheet projects over another at least at one edge thereof.

The encasement of the pane may be achieved in numerous ways. Some of these will be described in the following, serving only as examples and not limiting the scope of the invention.

One way of making the bordered pane module is shown in FIG. 2. Firstly, a sheet of glass 31 is provided with appropriate masking and/or priming (not shown) of the areas of attachment. The glass element 31 is then encased in a border element 32 by moulding as shown in FIG. 2*a*. The border element is preferably of polyurethane and may additionally contain a reinforcing element in the form of a fitting 33. The encased glass sheet is then combined with one or more additional sheets of glass 35 as shown in FIG. 2*b*. The glass sheets are kept apart by means of spacer members in the form of distance profiles 34 arranged along the border of the glass sheets. In the embodiment shown, the pane produced is of the step unit type, but the method may also be employed for making panes with glass sheets of identical size and shape.

When making a step unit pane in this manner, a space 36 remains between the border element and edge of the non-encased glass sheet, allowing the introduction of a caulking device for the purpose of establishing a secondary pane sealing.

The cavity formed between the glass sheets 31 and 35 and the distance profile 34 may be filled with an insulating gas. The advantages of the use of such a gas filling applies to all window panes described herein, even if not stated explicitly.

The reinforcing fitting 33 is designed to also be used for attaching the border element 32 to the window frame (not shown in FIGS. 2*a* and 2*b*).

Another way of achieving the bordered pane module shown in FIG. 2*b* is to start with a finished step unit pane and then encasing the exterior glass sheet 31 thereof.

A bordered pane module with a conventional pane having two glass sheets 51, 53 of identical size and shape may be made by encasing the pane as shown in FIG. 3. The encasing border element 54 is attached to the exterior glass sheet 51, to the sealing on the outside of the spacer member 52 and to the interior glass sheet 53.

As the border element itself serves as a secondary sealing there is no need for a space between the border element and the pane as mentioned above. This, however, entails that the mould must be designed to compensate for variations in the thickness of the pane, which is not necessary when encasing only the exterior glass sheet.

As mentioned above, a reinforcing fitting embedded in the border element also serve for connecting the border element to the frame. FIG. 4 shows two different embodiments, where corresponding elements 64, 641 are instead provided in the frame 65, 651. When moulding the border element 66, 661, these connecting fittings 64, 641 are embedded therein, thereby forming a secure connection of the border element to the frame. These fittings may extend over the entire length of the border element or may be present only locally.

A similar result may be achieved if the adhesion of the border element 66, 661 to the frame 65, 651 is particularly strong and stable, and the connecting element 64, 641 may then be left out. This may for instance be achieved by an appropriate priming of the area of attachment on the frame.

The moulded connection between the frame and the border element provides a particularly secure connection. However, the moulded connection necessitates the use of a mould that is big enough to hold both the frame and the pane element. Furthermore, it prevents subsequent detachment of the bordered pane module, meaning that the entire frame must be replaced if the pane is broken. This is of course a source of additional cost, but may in return be done by persons that are not specially trained for the purpose.

FIGS. 3 and 4 show conventional type panes, but the methods described in relation thereto may also be applied to the encasement of step unit panes as long as the edge of the larger glass sheet does not project too far over that of the smaller glass sheet. Likewise, the method shown in FIG. 2 may be combined with those of FIGS. 3 and 4 in that for example the upper and lower edges of the pane are encased by one method and the side edges by another. This is particularly advantageous when using a step unit, in which the larger glass sheet only projects over the smaller one at some sides, whereas their edges are in line at the others.

Attachment of the border element to the sheet element is achieved purely by the adhesive properties of the moulding material. The adhesion is established during the moulding process. To achieve good adhesion the areas of attachment may be covered by a mask and/or be primed, both possibly being achieved with one material. The masking may have the further purpose of contributing to the aesthetic value of the window and/or protecting the adhering material of the border element and the pane sealing from solar radiation. Such masks are generally non-transparent for UV-A and UV-B light, in some cases even totally lightproof. The mask may be a ceramic coating, UV hardening lacquer, a one- or two-component lacquer or any other suitable material.

Frame elements can be made from wood, plastic, polyurethane, polyurethane with a wooden core or any other material suited for the manufacture of window frames.

Instead of the connection by moulding described above the border element may be connected to the frame by means of any detachable or undetachable connecting means. Examples of detachable connecting means are screws, nails and other mechanical connection means, e.g. a click-system. Examples of undetachable connecting means are glue and adhesives. Examples of click systems are shown in FIGS. 5 and 6.

In FIG. 5 the border element 71 encases the exterior glass sheet 72, the spacer member and pane sealing 73, as well as the interior glass sheet 74. A fitting 76 embedded in the border element 71 has a tongue 77 with a barb 78, which engages with a catcher 79 on the frame element 75. The pane element of this embodiment is constituted by glass sheets 72, 74 and pane sealing 73.

The system depicted in FIG. 6 corresponds to the one in FIG. 5 as regards the overall configuration of the pane element, the border element, the fitting and the frame. In this case, however, the frame is provided with a fixation bushing 89 arranged to engage with a hole 88 in the projecting part 87 of the fitting 86. By turning the fixation bushing over 180 degrees, a tongue is engaged or disengaged. A screw 90 is used for fastening the bushing 89 in the frame element upon engagement of the tongue.

Releasable connections of the types described above have the advantage of allowing the pane module to be replaced. This not only allows the replacement of broken panes, but has much wider implications: An existing building may for example be given a new look by replacing the pane modules with ones of different appearance or the insulating properties of a building may be improved by replacing pane modules comprising older type panes with new ones having better insulating properties.

Moreover, the frames and pane modules can be manufactured and stored separately and then be interconnected once the requirements for a given window has been established. In this way windows may effectively be custom made from a pick-and-click system of different components.

The connection between the border element and the frame element is made in a manner that creates a watertight connection or at least so that moisture and water may be drained off in a controlled manner.

In special circumstances the border element may be connected directly to the load-bearing structure.

By forming the border element by encasement of the pane in the manner described in the above, a number of functional faces are obtained. That is, in contradistinction to a traditional pane, it is possible to integrate a plurality of functions into the border element. Such functional faces may include, but are not limited to, a) A first side face or inner face forming the pane receiving portion,
b) A second side face or outer face opposite the first side face and adapted to include fittings, sealings etc. forming part of the interface with the frame,
c) An exterior face defining the upper side facing outwards in the mounted position of the window, including e.g. water guidance means, protection means and/or having an aesthetically pleasing design,
d) An interior face adapted to be coupled to a frame element of a more traditional kind.

Examples of embodiments of the border element and of different functional faces are shown in FIGS. 7 and 8.

In FIG. 7 a masking 921 is provided on the interior side of the exterior glass sheet 92. The masking not only protects the pane sealing 93 from deterioration caused particularly by exposure to UVA and UVB light, it also serves an aesthetical purpose in that it conceals the pane sealing.

The surfaces 95, 952 of the glass sheets 92, 94, respectively, on which the border element 91 is to adhere, are primed to thereby achieve a high adhesive strength and the joints must prevent water from reaching the pane sealing 93. The glass sheets 92, 94 and the pane sealing 93 constitute the pane element of the embodiment shown in FIG. 7.

On the second functional face, i.e. the face facing away from the pane (left side in FIG. 7) a tongue-like weather strip 913 is provided for tightening the space between the two frames (not shown) of the window.

The exterior face, i.e. the upper functional face of the border element 91, is furthermore provided with a projecting feather 912, preferably running along the entire length of the border element. When the pane module is used with a window having a moveable frame mounted in a stationary frame, the feather will prevent water from running from the exterior surface of the pane into the space between the two frames (not shown). At the lower end of the window the feather 912 should be left out or interrupted to allow rainwater and the like to drain off unobstructed.

A fitting 96, which is embedded in the border element 91, projects out trough the fourth functional face 914 facing downwards in FIG. 7. The projecting part 961 of the fitting 96 is used for fixating the border element 91 and thus also the pane to the window frame element 97. In addition thereto the surface of the border element itself is provided with a rounded bead, which fits with a groove in the frame element 97 and thus serves as a guide for the positioning of the border and frame elements in relation to each other.

As described above, fittings may advantageously be used for the interconnection of the different parts of the window, but they may also serve other purposes. They may for example be used as strengthening and/or stiffening means, safety means for retaining the pane, hinges, locking assemblies, reception means for receiving screws and other fastening means, current carriers, holders for claddings and/or coverings etc.

A gasket 971 is provided between the interior glass sheet 94 and the frame element 97 for relieving the border of the pane and for draining off condensation forming on the inside of the pane, preventing it from reaching the border element 91 and pane sealing 93.

Further functionalities may be embedded in the interior of the border element. An example of this is the provision of a current-carrying component 99 providing an electrical connection between a solar energy collector (not shown) in the pane element and an electrical window opener, a roller shutter, a light source, a display showing meteorological information, a sensor used for controlling ventilation or the like. Other examples are the provision of optical fibres or a passage for a curtain cord.

An embedded member may also be used for providing a pre-stressing of the border element, which may counteract harmful stresses on the pane caused by wind suction. Such influences are particularly pronounced with roof windows mounted in inclined roof surfaces and in the case of centre-hung windows primarily affect the lowermost half of the pane, which is being dragged outwards and upwards. This causes compressive stresses on the pane, which may eventually cause it to break. By embedding a tensioned cable 99 in the material of the border element during moulding, a compressive force corresponding to the force of the tensioning will be applied to the material of the border element. Only wind forces, which are greater than the force of the tensioning, will thus cause stresses on the pane. The pre-stressing of the border element can of course be applied to the entire border element, but can also be limited to those border members, where it is most needed. As will be apparent to those skilled in the art, the pre-stressing may also be achieved in other ways, e.g. by tensioning the fittings 33, 64, 641, 76, 86, 96 or by applying a pre-stressed member (not shown) at level with or above the outer surface of the pane. A similarly effect could also be achieved by locally increasing the stiffness of the material of the border element, thus not actually causing a pre-stressing but instead increasing its resistance to bending.

The embodiment shown in FIG. 8 corresponds to the one shown in FIG. 7 in many respects and only variations will therefore be described.

In the embodiment of FIG. 8, the fitting 106 is of an angled configuration with one leg 1061 projecting from the lower face of the border element 101 and the other being embedded in the border element, substantially parallel to the pane 104. The angled shape of the fitting provides a better resistance to extraction and increases its moment of inertia. In this embodiment the border element extends inwards underneath the pane, replacing the gasket 98 used in the embodiment of FIG. 7. For the purpose of draining off condensation the border element is provided with a recess 1015. The larger downwards-facing surface of the border element allows the provision of two beads 1014 for positioning the border element in relation to grooves in the frame element 107. This allows an even more precise positioning and a larger shearing strength of the joint.

The joint between the pane and the border element may be designed in many different ways. Three of these are shown in FIG. 9.

In FIG. 9*a* the upper surface of the border element is level with the exterior surface of the pane 111 and the border element is provided with a feather for retaining water as described above. A mask 114 is provided for protecting and concealing the spacer member.

In FIG. 9*b* the border element is provided with a nose 117 projecting over the upper surface of the pane. This embodiment provides a better hold of the pane, as it will be kept in place in the unlikely event that the adhesion to the border element is deteriorated and as it is retained within the border element between the nose 117 and a shelf 119. This is of particular relevance when the pane is subjected to wind suction and to achieve more strength the nose may be provided with a metal inlay (not shown) or be formed by a projecting fitting. The nose may extend over the entire length of the border member, but can only be formed as local projection. A continuous nose protects the joint between the pane and the border element from the ingress of water and dirt.

The embodiments shown in FIGS. 9*a* and 9*b* are primarily intended for the upper and side edges of the window. At the lower edge rainwater and the like must be able to drain off and the border element will therefore often be of a configuration with no projecting feather. An example thereof is shown in FIG. 9*c*. It is, however, also possible to provide holes or interruptions in the feather 116 through which the water may be drained.

An even more elaborate embodiment is shown in FIG. 9*d*. Here the feather has been provided with a second nose 119 projecting substantially in parallel with a first nose 117 corresponding to the one in FIG. 9*b*. Together, the two noses form a groove, which may be used as a guide for a screening device, such as a roller shutter. To protect the groove from wear it may be provided with a liner in the form of a metal rail or the like (not shown), which may be encased in the border element during moulding thereof.

The border element of FIG. 9*d* may also be use for holding an additional sheet element. In this way is possible to achieve an alternative to a classical three-sheet pane by providing an extra sheet element on top of the two-sheet panes shown in FIGS. 2-8. This will be considerably cheaper and the single-sheet pane can be replaced on its own if broken or otherwise damaged. The insulating properties of such a one-plus-two configuration will be somewhere between that of two- and three-sheet panes both regarding sound and temperature.

In FIGS. 9*a*-*c* the pane is illustrated with a classical distance profile 112 used in common thermo panes, but a nose as the ones described above may also serve this purpose, particularly if constructing the two-layer pane simultaneously with moulding the border element.

Alternatively, the two-layer pane may be made with a spacer member having means for attachment to the border element. This may for example be achieved by providing the spacer member with a projecting attachment member (not shown), which is subsequently embedded in the border element during the moulding thereof, or by simply providing it with surface characteristics, which allows the material of the border element to adhere thereto.

Spacer member(s), particularly when in the form of distance profiles, may also provide additional functionalities, such as sound dampening, or additional members providing such functionalities may be provided in between the sheet elements of the pane.

The different types of spacer members may of course also be used in between the single-sheet pane and the two-sheet pane in the embodiment described above with reference to FIG. 9*d*.

Furthermore, it is to be understood, that one or more pane sheets could be replaced with sheets of other materials having e.g. decorative or insulating qualities.

If three sides of the window are provided with border elements of the type shown in FIG. 9*d* and the fourth with that in FIG. 9*c*, the grooves between the two noses will form a U into which the single-sheet pane may be slid. This embodiment thus allows subsequent addition of an extra sheet element, a sun screen or another functional element without the need for replacing or detaching the border element.

The border element of FIG. 9*d* is depicted as being formed in one by moulding. A similar result may, however, also be achieved by embedding an angular fitting in the exterior functional face of the border element (upwards in FIGS. 2-9), said fitting replacing the feather and the upper nose.

In FIG. 9*d* the two noses are depicted as being substantially parallel, but it is to be understood that non-parallel designs may also be envisaged. As an example the upper nose may declining towards the pane. In this way the noses may fixate a pane arranged between them or prevent end members of roller shutter lamellas from derailing.

The possibilities described in relation to the two-nosed embodiment may also be achieved with an embodiment having a groove formed between a shelf and a nose corresponding to that shown and described in relation to FIG. 9*b*. Similarly it is to be understood, that the dimensions of the noses, shelves, projections, feathers etc. in relation to the remaining parts of the border element need not be as depicted in the figures.

A screening device in the form of lamellas, which may be rotated about their own length axis but are otherwise stationary, also known as a louvre shutter, may also be mounted in a functional face of the border element (not shown). In this case a number of bushings corresponding to the number of lamellas are preferably encased in the border element on each side of the window, said bushings housing end members of the lamellas. The use of bushings is advantageous as the wear caused by the rotation of the lamellas will then not be on the border element. The bushings should preferably be replaceable. A border element having indentations suitable for receiving the ends of the lamellas directly may, however, also be used, particularly in designs where the border element itself is easily replaceable.

As may seen in FIGS. 3-8 the encasement of regular thermo panes and the like where the edges of the two sheet elements are in line may lead to a relatively bulky structure. It may therefore be advantageous to use step unit panes as the one shown in FIG. 2*b*, where one of the sheet elements of the pane project over the spacer member. The pane shown in FIG. 2*b* has only a small projection, but in other embodiments the exterior sheet element may project further in relation to interior one depending on the intended use of the pane. The exterior sheet element may for example be arranged to cover the exterior face (upwards in FIG. 2*b*) of the border element completely or it may even project beyond the border element to thereby achieve a pane area, which is invisible from the inside and large enough to carry solar cells or the like. As will be explained below, the projection of the exterior sheet element need not be the same on all sides of the pane.

FIG. 10 shows a series of examples of two-sheet step unit panes, where the two sheet elements are displaced in relation to each other in different ways. In FIG. 10*a* one of the two rectangular sheet elements of the pane projects over the other on all four sides, whereas the larger sheet element of FIGS. 10*b* and 10*c* only projects on two parallel sides. Having a projection only on some sides may for example be an advantage when mounting several windows closely side-by-side or above each other.

A large one-sided projection as the one shown in FIG. 10D may be used if solar cells or the like are to be arranged on the pane. These functional elements will then be invisible from the inside. The large projection may also be used for shielding or covering a roller shutter top casing belonging to another window mounted below.

Asymmetrical designs as those shown in FIGS. 10E and 10F may also be employed in special circumstances, where different functional elements are to be arranged on or underneath the pane and/or where windows are to be arranged in a two-by-two configuration.

The two sheet elements may also have different shapes as illustrated in FIG. 10G, where the larger sheet element is square while the smaller one is round. This embodiment may, for example, be used with a light well with a round cross section, the corners of the larger sheet element being invisible from the interior. These corners may for example be provided with solar cells or fibreoptic light guides transmitting light to the room beneath the light well.

In the above, the pane module has been described as either constituting a sash in itself or as constituting an element to be coupled to a further element to constitute a sash, in the sense that the sash is openable. The sash could also be fixed, i.e. not openable in the traditional sense but connected to a traditional frame. Furthermore, it would be possible to integrate the sash and the frame into a single element, or to form the sash as a traditional window frame for connection to the roof structure. All of these interpretation could be applied to the term "frame" within the context of the present application.

Furthermore, it is conceivable to make use of other configurations of the pane element. For instance, there may be more than two sheets of glass, and the sheets need not to be plane and/or parallel with each other. A further alternative conception lies in the possibility of applying at least some of the principles underlying the present invention to pane modules including a single sheet of glass.

In general, the features and functional units of the embodiments shown and described may be combined freely and no feature should be seen as essential unless stated in the claims.

The invention claimed is:

1. A pane module adapted to be installed in a window frame and comprising a pane element, a border element and a projecting fitting, the projecting fitting being a separate piece from the border element, the border element having an innermost surface facing an interior of a building structure when the pane module is in a mounted state, wherein the pane element includes at least two sheet elements separated by one or more spacer members, wherein the border element is made by moulding, wherein each sheet element has an edge defining a periphery, wherein the border element surrounds the pane element, at least partially encasing the edge of at least one of the sheet elements, wherein the border element has at least one functional face, at least a portion of the fitting being disposed outwardly beyond the periphery of at least one of the sheet elements and extending inwardly away from the innermost surface, and the projecting fitting being configured such that one or more screws attach the projecting fitting to the window frame when the pane module is installed in the window frame.

2. A pane module according to claim 1, wherein the sheet elements are parallel to each other.

3. A pane module according to claim 1, wherein the pane element is rectangular, square, circular, semi-circular, triangular or trapezoidal.

4. A pane module according to claim 1, wherein each sheet element has a plurality of edges, and the border element encases all edges of at least one of the sheet elements.

5. A pane module according to claim 1, wherein the edge of each of the at least two sheet elements is encased by the border element.

6. A pane module according to claim 1, wherein the border element has a functional face having a nose projecting over the edge of the pane element above a surface facing an exterior when the pane module is in a mounted state, the nose covering a joint between the pane element and the border element.

7. A pane module according to claim 1, wherein, at a joint between the border element and the pane element, the border element has a functional face level with a surface of the pane element facing an exterior when the pane module is in a mounted state.

8. A pane module according to claim 1, wherein, at a joint between the border element and the pane element, the border element has a functional face level with a surface of the pane element facing an interior when the pane module is in a mounted state.

9. A pane module according to claim 1, wherein the border element has a functional face on which a feather faces an exterior when the pane module is in a mounted state, said feather projecting substantially perpendicularly to the plane of the pane element and to a level above the surface of pane element facing the exterior when the pane module is in the mounted state.

10. A pane module according to claim 9, wherein the feather is provided with drain holes or interruptions.

11. A pane module according to claim 9, where at least a part of the border element has no feather.

12. A pane module according to claim 1, wherein the pane element has a plurality of edges, wherein the border element consists of a plurality of border members, wherein the plurality of border members includes a border member for each of the plurality of edges on the pane element, and wherein at least two border members are of different designs.

13. A pane module according to claim 1, wherein the border element is made from a thermoplastic material.

14. A pane module according to claim 13, wherein the border element is made from polyurethane or polyolefin.

15. A pane module according to claim 1, wherein the border element is made by reaction injection moulding (RIM) or low pressure moulding.

16. A pane module according to claim 1, wherein the pane element has at least one of the following properties: sound reducing, insulating, light reflecting, light absorbing, light transmitting.

17. A pane module according to claim 1, wherein the border element has an embedded fitting projecting through a functional face thereof for connecting the border element to a window cladding element or for serving as a safety device retaining the pane element.

18. A pane module according to claim 1, wherein the border element is provided with an embedded fitting projecting through a functional face thereof for connecting the border element to a window screening element.

19. A pane module according to claim 1, wherein the fitting is embedded in the border element.

* * * * *